United States Patent [19]

Walker

[11] Patent Number: 4,703,850

[45] Date of Patent: Nov. 3, 1987

[54] SHOE BOX

[76] Inventor: Jimmie Walker, 612 Linnet Rd., Audubon, Pa. 19407

[21] Appl. No.: 869,626

[22] Filed: Jun. 2, 1986

[51] Int. Cl.[4] ..... B65D 85/18

[52] U.S. Cl. ..... 206/293; 206/288; 206/806; 211/34; 211/35; 232/43.1; 232/22

[58] Field of Search ..... 206/1.5, 278, 288, 293, 206/570, 803, 806; 211/34, 35, 38, 87; 312/245, 246, 247, 283, 286; 232/1 B, 43.1, 22

[56] References Cited

U.S. PATENT DOCUMENTS

| | | | |
|---|---|---|---|
| 803,086 | 10/1905 | Arnold | 211/34 |
| 1,595,263 | 8/1926 | Thornberry | 312/286 |
| 1,606,944 | 11/1926 | Johnson | 206/806 |
| 1,921,110 | 8/1933 | Wheary | 206/293 |
| 2,114,441 | 4/1938 | Laney et al. | 211/35 |
| 2,410,475 | 11/1946 | Anderson | 206/1.5 |
| 2,698,689 | 1/1955 | Novack | 206/293 |
| 3,128,866 | 4/1964 | Ratowsky | 312/286 |
| 3,707,225 | 12/1972 | Miles et al. | 206/293 |
| 3,725,188 | 4/1973 | Kalt | 206/813 |
| 4,494,690 | 1/1985 | Dupuis | 232/43.1 |
| 4,611,716 | 9/1986 | Sorlien | 206/806 |

FOREIGN PATENT DOCUMENTS

| | | | |
|---|---|---|---|
| 568779 | 7/1958 | Belgium | 206/278 |

*Primary Examiner*—Stephen P. Garbe
*Assistant Examiner*—David T. Fidei
*Attorney, Agent, or Firm*—Norman E. Lehrer

[57] ABSTRACT

A shoe box is disclosed for safely and temporarily holding shoes of a hotel guest on the outside of a hotel room door so that the shoes can be picked up, shined and returned and which does not require that the hotel guest have a key to open the shoe box. The box is substantially rectangularly shaped and includes a top wall, a bottom wall and a pair of side walls. The back of the box includes a border around the perimeter defining an opening for insertion and removal of the shoes by the guest when the box is removed from the door. A hinged cover including a lock can only be opened by an attendant for removing the shoes for polishing or for replacing them. The top rear of the box carries a bracket which fits over the top of a door to suspend the box thereon with the back of the box flush against the door. Cushing material on the back of the box and on the inside of the cover reduce the noise which would otherwise be created when the box was being hung on the door or when the cover was being closed.

3 Claims, 5 Drawing Figures

SHOE BOX

BACKGROUND OF THE INVENTION

The present invention is directed toward a shoe box and, more particularly, toward a shoe box which can safely and temporarily hold the shoes of a hotel guest on the outside of a hotel room door so that the shoes can be picked up, shined and returned and which does not require that the hotel guest have a key to open the box.

Many better hotels in the United States and elsewhere provide valet service to their guests for having suits or other articles of clothing cleaned and/or pressed. In order to advise the hotel that a guest wishes to utilize such a service, the guest is often requested to place the clothes in a specially provided bag and to place the same outside of his door. Obviously, such a procedure can often result in theft of such clothing.

In order to prevent such theft, older hotels provided guest room doors which included an interior chamber which was accessible from either the interior of the room or the hallway. When a guest wished to have a suit pressed, for example, he would unlock and open the interior chamber cover and place the suit therein. A sign or other type of visual signaling device notified personnel that there was something within the chamber. The hotel personnel could then unlock the outer chamber cover and remove the suit. While such arrangements were workable, they are seldom utilized in modern hotels because of the considerable cost involved in constructing doors with the required interior chambers.

To the best of Applicant's knowledge, no one has ever attempted to develop an arrangement such as a housing or the like which can be attached to an existing door for valet cleaning services in a hotel. Furthermore, to the best of Applicant's knowledge, hotel valet services have never offered shoe shining service. This is probably due to the difficulty in arranging for the pick up and delivery of shoes without significantly inconveniencing a hotel guest.

Locked receptacles for leaving items outside of a door have been proposed in the past although not specifically for leaving shoes to be shined. Examples of such prior art proposals are shown in U.S. Pat. Nos. 3,934,434 and 2,273,580.

The former patent utilizes a combination lock which must be used by both the person placing the article inside the housing and the person desiring to remove the article therefrom. Thus, if such a device were utilized in a hotel, each guest would have to be given the combination to the lock which would create a later security problem. The second mentioned patent utilizes a key rather than a combination lock and includes a housing having an opening at one end thereof through which a person can insert an article into the housing without unlocking the same. The particular construction of the receptacle shown in this patent, however, makes the same totally unusable for shoes.

SUMMARY OF THE INVENTION

The present invention is designed to provide a receptacle or shoe box for safely and temporarily holding shoes of a hotel guest on the outside of a hotel room door so that the shoes can be picked up, shined and returned and which does not require that the hotel guest have a key to open the shoe box. The box is substantially rectangularly shaped and includes a top wall, a bottom wall and a pair of side walls. The back of the box includes a border around the perimeter defining an opening for insertion and removal of the shoes by the guest when the box is removed from the door. A hinged cover including a lock can only be opened by an attendant for removing the shoes for polishing or for replacing them. The top rear of the box carries a bracket which fits over the top of a door to suspend the box thereon with the back of the box flush against the door. Cushing material on the back of the box and on the inside of the cover reduce the noise which would otherwise be created when the box was being hung on the door or when the cover was being closed.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
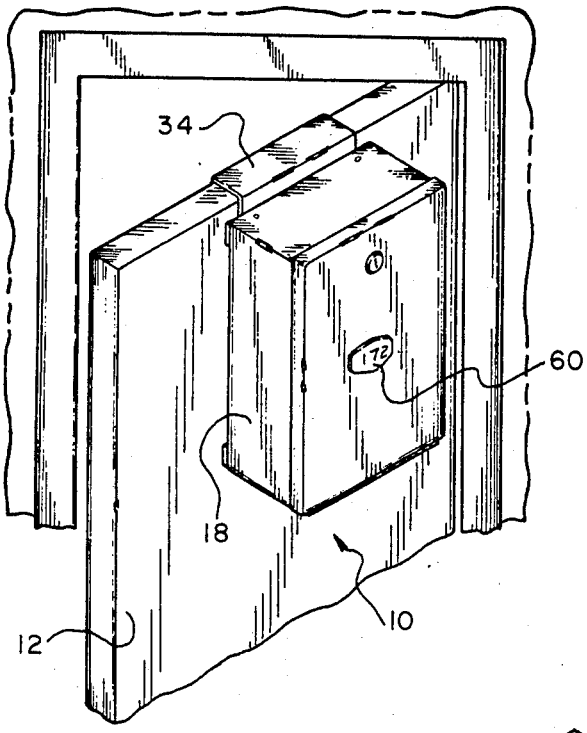
FIG. 1 is a front perspective view of a shoe box constructed in accordance with the principles of the present invention and shown suspended on a hotel room door.
Figure 2:
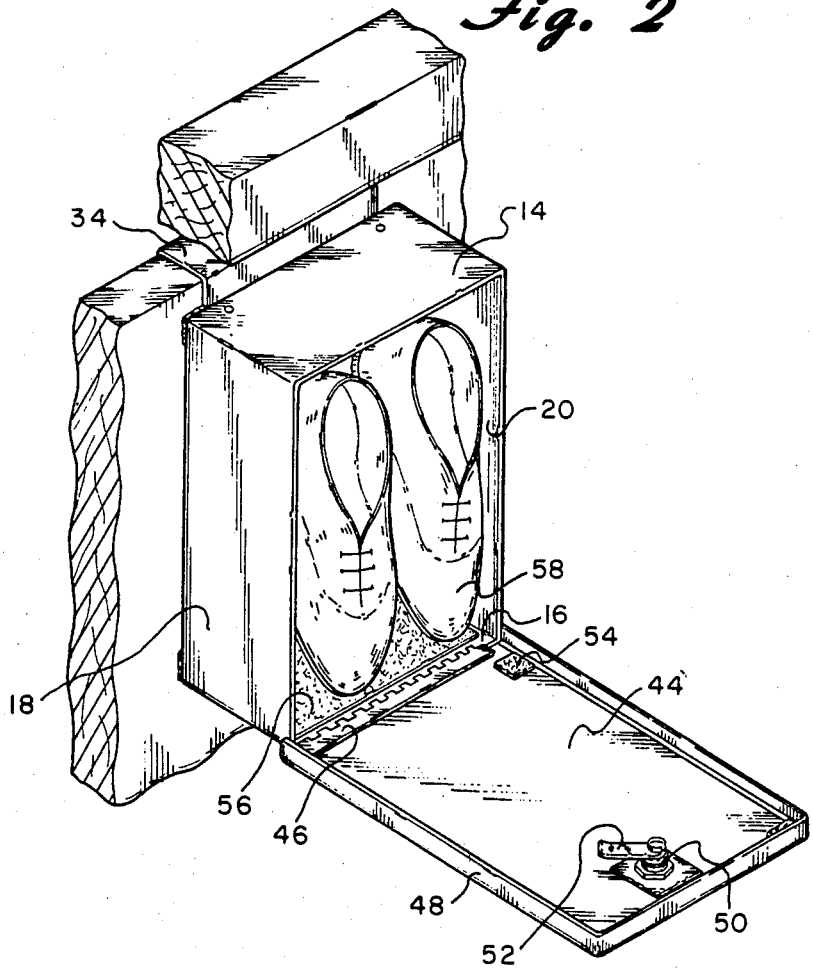
FIG. 2 is a view similar to FIG. 1 but showing the front cover in an open position so that the shoes within the box can be removed.
Figure 3:
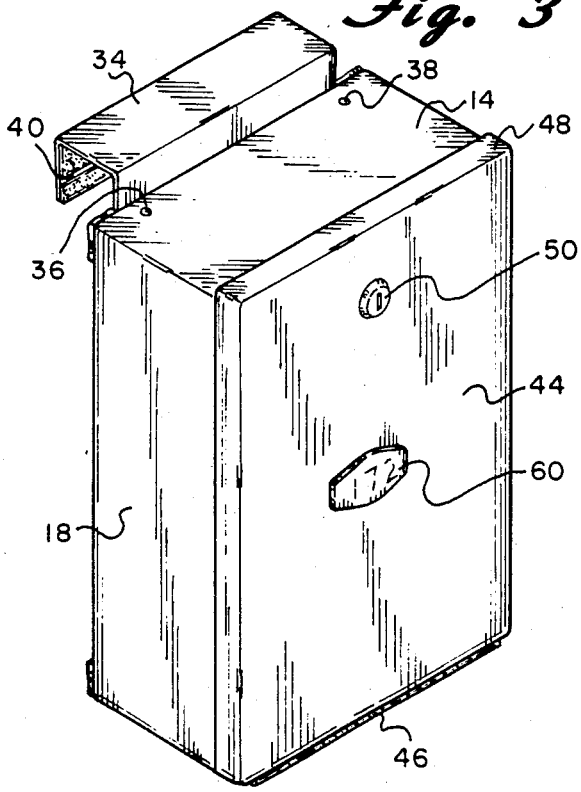
FIG. 3 is a front perspective view similar to FIG. 1.

Referring now to the drawings in detail wherein like reference numerals have been used throughout the various figures to designate like elements, there is shown in each of the figures a shoe box constructed in accordance with the principles of the present invention and designated generally as 10. In FIGS. 1 and 2, the shoe box 10 is shown suspended from the top of a hotel room door 12 on the outside thereof so that the box extends into the hallway.

The shoe box 10 is substantially rectangularly shaped and includes a top wall 14, a bottom wall 16 and left and right side walls 18 and 20. The back of the box 10 includes a partial rear wall in the form of a border including a top portion 22, left and right side portions 24 and 26 and a substantially larger bottom portion 28.

The partial rear wall thus forms a substantially rectangularly shaped opening 30 at the back of the box which is large enough to pass a pair of shoes therethrough. An elastic strap 32 is secured to and extends between the left and right portions 24 and 26 of the partial rear wall. This strap 32 can be stretched out of the way to allow the shoes to be inserted through the opening 30 but will then help to retain the shoes in place and prevent them from falling out when the box 10 is being moved.

Figure 5:
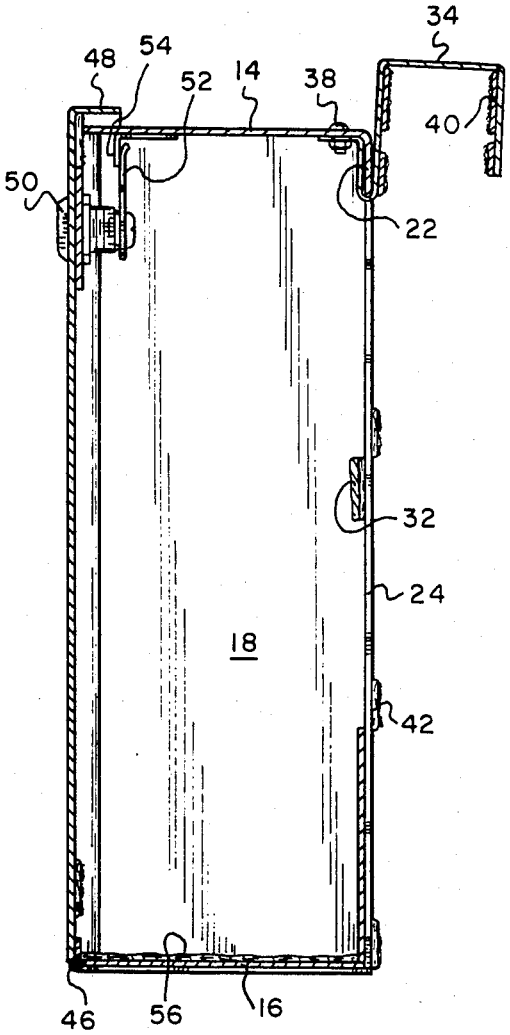
FIG. 5 is a cross-sectional view taken through the line 5—5 of FIG. 4.

An elongated bracket 34 which extends substantially the entire width of the top wall 14 is secured to the top portion 22 of the partial rear wall by bending the end of the bracket around the portion 22 as shown in FIG. 5. The extreme inner end of the bracket 34 may also be bolted to the top wall 14 through the use of bolts 36 and 38 which pass through the wall 14 and the bracket 34. It should be readily apparent to those skilled in the art that other known types of fastening means such as rivets or welding could also be utilized.

The bracket 34 is shaped substantially as an inverted U. The dimensions of the bracket are chosen so that the same fits snugly over the top edge of a standard hotel room door such as shown in FIGS. 1 and 2. The innermost surface of the bracket 34 is preferably covered with a padding material 40 which may be comprised of felt, foam rubber or other similar material which will reduce noise and prevent scratching or marring of the door when the bracket 34 is placed over the door.

Figure 4:
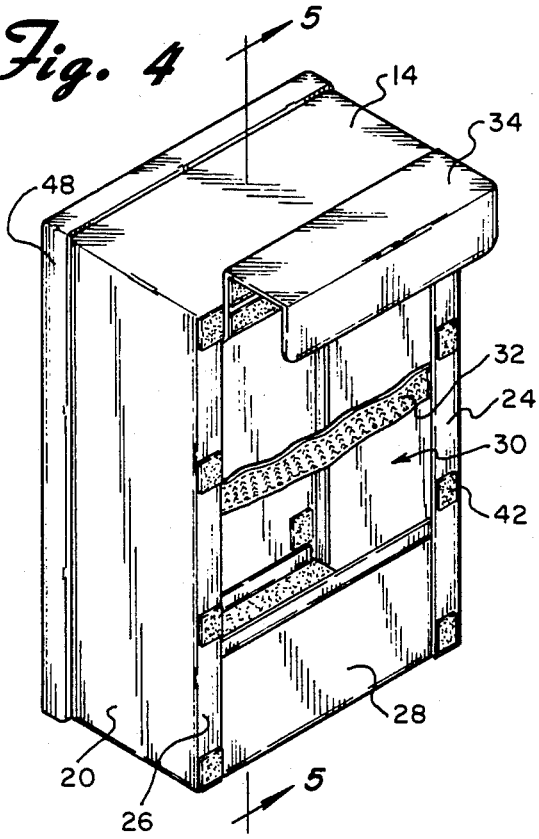
FIG. 4 is a rear perspective view of the shoe box.

Similarly, gasket or padding means may also be provided on the partial rear wall of the box to reduce noise and to prevent scratching of the door. In the preferred embodiment best shown in FIG. 4, the gasket means are comprised of a plurality of individual pads 42 secured to and spaced around the left and right side portions 24 and 26 of the partial rear wall.

At the front of the box 10 is a cover 44. The cover 44 is pivotally secured to the bottom wall 16 of the box by the use of elongated hinge means 46. Thus, the cover 44 pivots about a horizontal axis between a lowered open position such as shown in FIG. 2 and a raised closed position as shown in the remaining figures.

The cover 44 is slightly larger than the opening at the front of the box and includes an upstanding flange extending along the sides and top thereof. As a result, when the cover is closed, the flange 48 overlaps the forward edges of the top wall 14 and side walls 18 and 20 to help prevent someone from inserting a tool between the cover and the remaining parts of the box to pry the same open.

Located in the upper portion of the cover 44 is a key lock assembly 50. The locking assembly 50 includes a rotatable lever 52 which is rotated when the key is inserted into the lock assembly 50 and turned. The lever 52 is movable between an open position shown in FIG. 2 and a locking position wherein the lever 52 engages a keeper member 54 secured to the top wall 14. Preferably, the lock assembly 50 is of the type that the key cannot be removed unless it is in the locked position. As a result of the foregoing arrangement, it will be almost impossible to inadvertently leave the cover 44 unlocked since in its unlocked condition, it will tend to fall into its open position.

Located on the inner surface of the cover 44 adjacent the outer edges thereof are gasket means which may also be in the form of a plurality of individual pads such as shown at 54 in FIG. 2. The pads 54 engage the front edges of the top and side walls 14, 18 and 20 of the box to reduce or substantially eliminate noise when the cover 44 is closed. The inner surface of the bottom wall 16 may also be covered with a padding material 56 in order to protect the shoes such as the pair of shoes 58 shown in FIG. 2 which are placed in the box 10.

The shoe box 10 of the present invention is utilized in the following manner. The box is normally maintained within the hotel guest's room on a shelf or counter or the like. Each box will have a label such as shown at 60 secured to the front surface of the cover 44 which will carry indicia thereon identifying the room to which the box is associated. Thus, box 172 shown in FIGS. 1 and 2 will be utilized in room 172 of the hotel.

If the hotel guest in room 172 wishes to have his shoes shined, he will place the shoes in the box through the opening 30 at the back thereof. The hotel guest will not have and does not require a key to open the cover of the box which is normally in its locked position. Before retiring for the night, the guest hangs the box 10 from his hotel room door by placing the bracket 34 over the top edge of the door. He then closes the door to secure the box thereto. In this condition, the shoes are safe within the box since the bracket 34 in cooperation with the door and the door jam maintains the back of the box substantially flush with the surface of the door so that the shoes cannot be removed through the opening 30. It should be noted that because of the gasket or padding means 40 and 42, the guest will not disturb any of the other guests since noise is substantially eliminated as the box is being suspended onto the door. Furthermore, as the guest maneuvers the box to suspend the same properly on the door, the elastic strap 32 prevents the shoes from falling out.

At a predetermined time during the night, a hotel employee or possibly a private contractor will police the hotel halls and, utilizing his key, will remove the shoes from any boxes which he sees by lowering the front cover. After removing the shoes, the cover will be closed and locked and the gasket or padding means 54 will reduce the noise which otherwise might be created when the cover is closed. After the shoes have been shined, the service man will return the shoes to the proper box and in the morning the guest will remove the box from the door and will remove his shined shoes from the opening 30 at the back of the box.

It should be readily apparent to those skilled in the art that the major components of the box 10 may be comprised of substantially any strong rigid material. In the preferred embodiment of the invention, the box is made primarily of sheet metal. However, other strong materials or combinations of materials could be utilized.

The present invention may be embodied in other specific forms without departing from the spirit or essential attributes thereof and accordingly reference should be made to the appended claims rather than to the foregoing specification as indicating the scope of the invention.

I claim:

1. A shoe box for temporarily holding a guest's shoes outside of a hotel room door so that they can be picked up, shined and returned comprising:

a substantially rectangularly shaped box including a top wall, bottom wall, left and right side walls and a partial rear wall, the back of said box being substantially open except for said partial rear wall with said opening being large enough to pass a pair of shoes therethrough;

said partial rear wall being in the form of a border and including a bottom portion, a top portion and left and right side portions;

an elastic strap extending between said left and right side portions of said partial rear wall substantially centrally of said opening;

an elongated bracket secured to the top portion of said partial rear wall, said bracket being adapted to fit over the top edge of a door to support said shoe box thereon with said rear opening substantially flush against the outer surface of said door;

gasket means mounted on said partial rear wall to cushion said rear wall against said door;

a front cover for said box;

hinge means pivotally securing said cover to said box, said hinge means being connected to said bottom wall and to the bottom of said cover so that said cover pivots about a horizontal axis between a lowered open position and a raised closed position;

gasket means located on the inner surface of said cover for cushioning the same against said top and side walls when said cover is closed to reduce the noise generated from said closing, and a key lock means in said cover for locking and unlocking the same to and from its closed position.

2. The shoe box as claimed in claim 1 wherein the inner surface of said bottom wall is covered with a padding material.

3. The box as claimed in claim 2 further including a label on the outer surface of said cover having indicia thereon corresponding to the hotel room number.

* * * * *